US005299171A

United States Patent [19]

White et al.

[11] Patent Number: 5,299,171

[45] Date of Patent: Mar. 29, 1994

[54] TORPEDO DECOY SIGNAL GENERATOR

[75] Inventors: Philip K. White, Lynn Haven; Clell A. Dildy, Jr., Panama City, both of Fla.

[73] Assignee: The United States of America as represented by the Secretary of the Navy, Washington, D.C.

[21] Appl. No.: 62,782

[22] Filed: Jul. 20, 1970

[51] Int. Cl.[5] ..... H04K 3/00

[52] U.S. Cl. ..... 367/1; 434/6

[58] Field of Search ..... 340/5 R, 5 D, 384 E; 343/18 R, 18 E; 331/47, 78, 179; 367/1; 434/6

[56] References Cited

U.S. PATENT DOCUMENTS 3,165,734 1/1965 Grodzinsky et al. ..... 340/384 E 3,311,868 3/1967 Cupp et al. ..... 367/1

*Primary Examiner*—Daniel T. Pihulic

*Attorney, Agent, or Firm*—William C. Townsend; K. W. Dobyns

[57] ABSTRACT

A torpedo countermeasure decoy which produces and broadcasts signals that are usually more attractive to a homing torpedo than those emanating from its intended target. Timely reset staircase generators combined with timely opened and closed gates generate stairstep signals which are added by a summing amplifier to produce a programmed composite signal thereof. A bank of voltage-controlled oscillators are driven by said composite signal in such a manner as to produce a predetermined plurality of discrete frequency signals within a predetermined plurality of consecutive but separated frequency bands within a given frequency spectrum, all of which are then effectively broadcast within the aqueous medium in the ambient environment of the torpedo's intended target—that is, the vessel to be protected.

16 Claims, 2 Drawing Sheets

TORPEDO DECOY SIGNAL GENERATOR

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention relates, in general, to the field of signal generators, and, in particular, it is a unique method and means for producing decoy signals that are attractive to a homing torpedo because they effectively substitute for or simulate the signals produced by various and sundry ships and other marine target vehicles. In even greater particularity, the subject invention is an electronic generator for producing a unique interlaced staircase electrical signal having copious uses and applications per se.

DESCRIPTION OF THE PRIOR ART

Heretofore, sweep generators have been employed for the purpose of producing torpedo decoy signals. As a general rule, the outputs thereof are sawtooth type signals having substantially direct current voltage ramps which increase with time from zero voltage to, say, +5 volts and then rapidly return to zero volts. Such sawtooth signals are then supplied to a single high frequency voltage controlled oscillator which, in turn, produces a substantially linear swept frequency signal. This linear swept frequency signal is then divided into the number of bands desired, usually six.

Although the aforementioned prior art works quite well for many practical purposes, it leaves a great deal to be desired when used for the purpose of generating signals intended to attract—and, thus, decoy—the more modern, sophisticated, known homing torpedoes. For instance, since many modern homing torpedoes will not accept either broadband noise or a swept frequency signal as a valid target, the prior art decays employing such procedures will not function properly to produce the results desired. Moreover, because modern homing torpedoes incorporate comb filters in their received signal processors, to simulate a valid target upon which they will home requires that the signal received thereby will not appear in more than one band at the same time; hence, the broadband type of signal produced by the prior art decoy signal generators will not work. In addition, while a swept frequency signal might satisfy the aforesaid requirement, a rapidly moving signal—that is, a rapidly changing frequency signal—represents unrealistic doppler, and discrimination against the swept signal producing it would, in all probability, be effected on such basis.

These more sophisticated homing torpedo systems also employ duration gates which require that a received signal persist above a certain threshold for a certain period of time, say, of the order of eighty milliseconds, in order to be acceptable as valid target signals. Another important requirement for such acceptance is that the received signal be pulse-like and have a predetermined rate of rise, probably of the order of 0.6 db per milli-second or greater. Of course, it is very difficult, if not impossible, for a swept frequency signal to satisfy both of said last mentioned requirements simultaneously, inasmuch as the long duration thereof necessitates that the sweep rate be slow, while, at the same time, the rise rate necessitates that the sweep rate be fast.

In view of the foregoing, it may readily be seen that a new and different technique is required if sophisticated homing torpedoes are to be decoyed in a satisfactory manner to thereby effect optimum protection for the target vessel being attacked.

SUMMARY OF THE INVENTION

The present invention overcomes many of the disadvantages of the prior art, in that it produces a decoy signal that is highly attractive to the technically sophisticated homing torpedoes presently in existence and, in most instances, is even more attractive thereto than the signals emanating from or reflected by the intended target vessel or vehicle. The improvement is ostensively caused by generating signals which fall into six sub-bands within the entire band of frequencies to be broadcast as decoy signals, with said six sub-bands established on a constant percentage—or constant Q—basis. It has been found that such approach is justified because: (1) homing torpedo bandwidths are ordinarily designed to be narrower at the lower frequencies and get progressively wider as the frequency thereof increases, in order to meet the doppler requirements, since doppler frequencies behave in the same way; and (2) so doing allows a more simplified construction to be used, from which better performance is obtained.

It is, therefore, an object of this invention to provide an improved homing torpedo decoy.

Another object of this invention is to provide a signal generator that will efficiently produce signals that are highly attractive to various homing vehicles.

Still another object of this invention is to provide an improved method and means for generating signals which may be used to substitute for the signals emanating from or reflected by a target vehicle intended to be attacked and destroyed by a homing torpedo, missile, or other vehicle.

A further object of this invention is to provide an improved method and means for generating a decoy signal not having broadband noise and/or a swept frequency signal included therein.

A further object of this invention is to provide a method and means for generating a simulated target echo signal that does not have frequencies occurring simultaneously in more than one comb filter.

Another object of this invention is to provide an improved method and means for generating a decoy signal that is not discriminated against by a homing torpedo or other missile as a result of having unrealistic-doppler frequencies included therein.

Another object of this invention is to provide an improved homing torpedo countermeasure or other jamming device.

Another object of this invention is to provide an improved free-running torpedo decoy signal generator which produces an optimum number of decoy signals per unit of time.

Another object of this invention is to provide an improved interlaced staircase generator.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
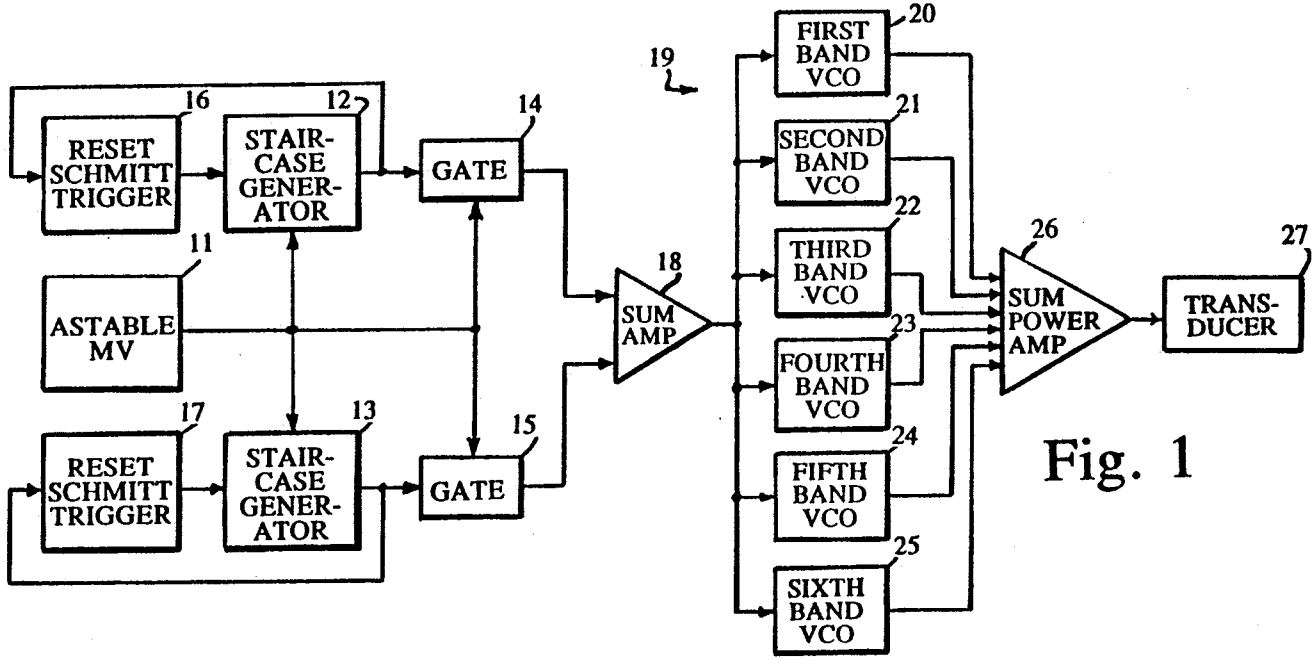
FIG. 1 is a block diagram of the system constituting the subject invention.

Referring now to FIG. 1, there is shown an adjustable, free-running, astable multivibrator 11, with the output thereof connected to the trigger signal inputs of a pair of staircase generators 12 and 13 and to the control inputs of a pair of gates 14 and 15. The outputs of staircase generators 12 and 13 are respectively connected to the data signal inputs of said gates 14 and 15.

It should perhaps be understood at this time that staircase generators 12 and 13 may be of any appropriate, conventional type that produce increasing stairstep voltage signals in response to predetermined control or trigger signals being supplied thereto. Such generators may, for example, be the kind depicted and discussed at page 73 of the Applications Manual of Philbrick Researches, Inc., of Dedham, Mass., dated 1966.

Likewise, gates 14 and 15 may be any of many conventional types which allow a data signal to timely pass therethrough in response to a predetermined opening control signal.

The outputs of staircase generators 12 and 13 are respectively connected to the data signal inputs of the aforesaid gates 14 and 15 and to the control inputs of a pair of adjustable reset Schmitt triggers 16 and 17, the outputs of which are respectively connected to the reset inputs of said staircase generators 12 and 13.

The outputs of gates 14 and 15 are connected to the inputs of a summing amplifier 18, the output of which is connected to the inputs of a bank of voltage controlled oscillators 19 having a plurality of voltage controlled oscillators 20 through 25 incorporated therein. As may readily be seen from FIG. 1, the output of summing amplifier 18 is connected to the inputs of each of said voltage controlled oscillators 20 through 25, and the outputs thereof are connected to the inputs of summing power amplifier 26. The output of summing power amplifier 26 is connected to the input of an electro-acoustical transmitting transducer 27 in such manner as to effect the energization thereof.

The aforesaid voltage controlled oscillators 20 through 25, as they are employed in the preferred embodiment of the invention discussed herewith, each generate a plurality of discrete frequency signals within a given frequency band. Because six of them are used in this instance, six of such frequency bands are effected which are preferable in consecutive or spaced consecutive arrangements.

Also, with respect to the aforesaid voltage controlled oscillators 20 through 25 and summing power amplifier 26, it should be understood that although this arrangement is preferable for most operational circumstances, alternate combinations thereof may be employed, too. For example, it would obviously be within the perogative of the artisan to respectively connect individual power amplifiers to the outputs of said voltage controlled oscillators, which, in turn, have their outputs connected to respective energy converter portions of a predetermined transmitting transducer designed for such purpose. Or, in the alternative, said individual power amplifiers could have their outputs summed and then connected to the input of a suitable transmitting transducer.

FIGS. 2(A), (B), (C), and (D), as previously suggested, illustrate typical waveforms of the signals that occur at the outputs of various ones of the components of the system of FIG. 1. They are all disclosed in their idealized form, so as to facilitate their being explained further during the discussion of the operation of the subject invention presented subsequently. However, it may be stated at this time that FIG. 2(A) illustrates a typical squarewave signal that may constitute the output from astable multivibrator 11, FIG. 2(B) illustrates a typical stairstep signal that may constitute the output from staircase generator 12, FIG. 2(C) illustrates a typical stairstep signal that may constitute the output from staircase generator 13, and FIG. 2(D) illustrates the timely summing of the waveforms of FIGS. 2(B) and (C), and, thus, constitutes the output from summing amplifier 18. FIGS. 2(A) through (D) are all time correlated along the same time base, which may be varied in accordance with the adjustment of the frequency of multivibrator 11. Of course, the amplitudes of each thereof may be varied, too, by conventional design procedures, inasmuch as each of the blocks of FIG. 1 represent well known conventional devices per se.

Figures 2, 3, 5:
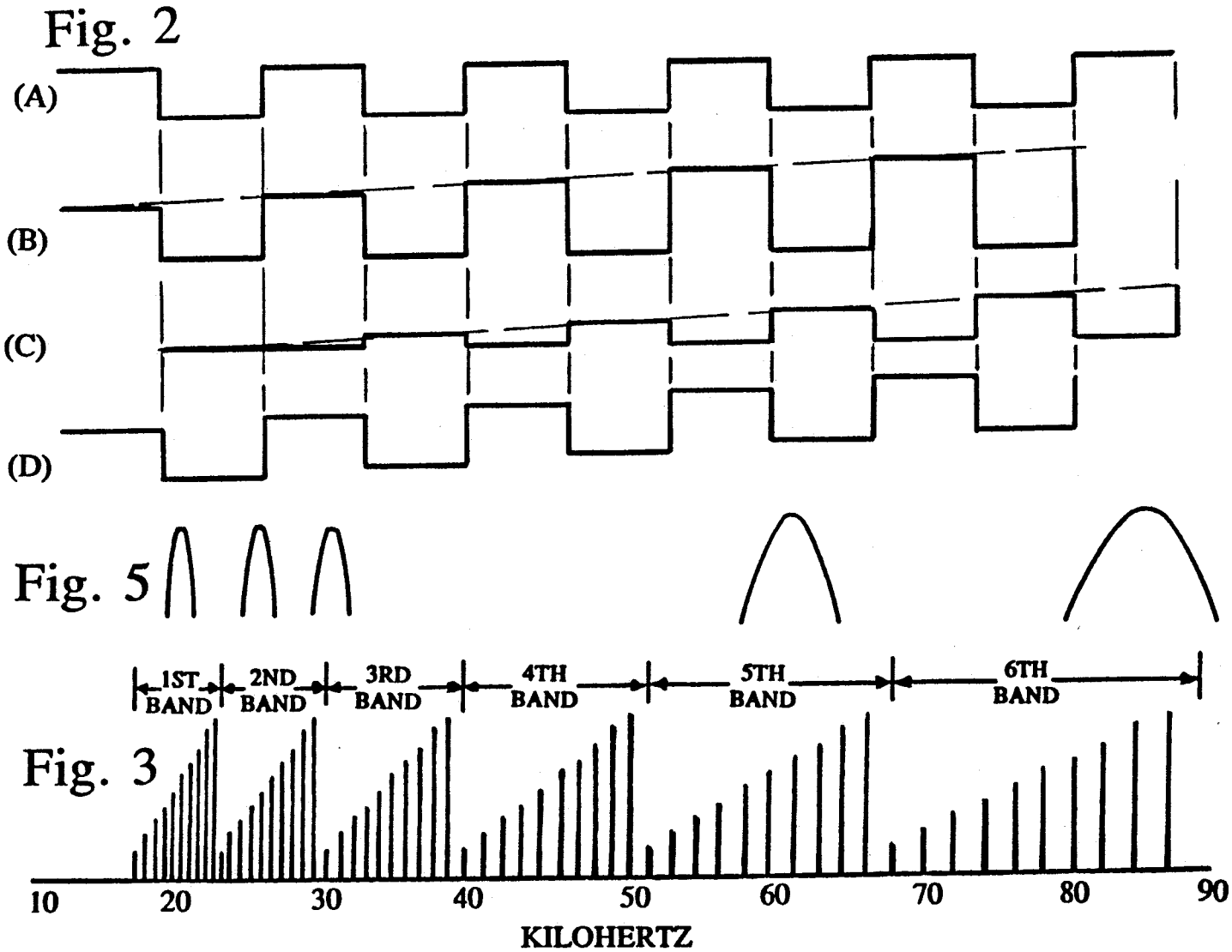
FIG. 2 is a graphical representation of the output signals generated by various ones of the devices incorporated in the system of FIG. 1.
FIG. 3 is a graphical representation of signals included in the six frequency bands produced by the six voltage controlled oscillators of the system of FIG. 1.
FIG. 5 illustrates hypothetical passbands of various and sundry torpedoes that are correlated in frequency with the signals of FIG. 3.

FIG. 3 discloses six frequency bands located within approximately a ten to ninety kilohertz broad frequency spectrum. And each of said six bands is, in turn, divided up into ten discrete frequencies that are proportional to the voltage steps of the outputs of the aforesaid voltage controlled oscillators 20 through 25, respectively. Different length lines are used in the figure only to facilitate distinguishing between each of the ten discrete frequencies in each of said six bands; thus, no other connotation should be placed thereon.

Figure 4:
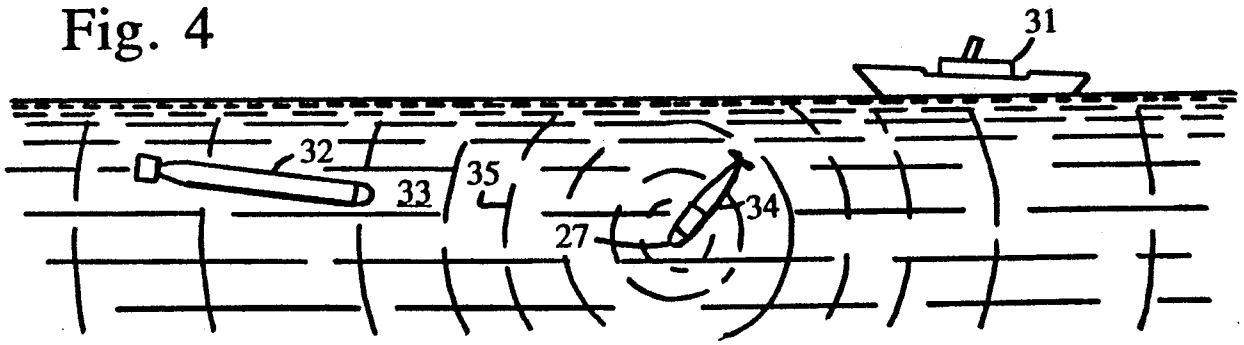
FIG. 4 is a quasi-pictorial representation of the manner in which the subject invention can be deployed to protect a vessel being attacked by a torpedo.

Referring now to FIG. 4, there is shown in quasi-pictorial representation a ship 31 which is an intended target of a torpedo 32, as it travels along its course in water 33. Decoy 34 incorporating the subject invention broadcasts signals 35 to attract torpedo 32 away from its path of intercept with ship 31, thereby saving ship 31 .

FIG. 5 discloses, in simplified graphical form, the frequency response characteristics of several hypothetical torpedo receiving and homing systems. For disclosure purposes only, said torpedo response characteristics have their center frequencies located at 20, 25, 31, 61, and 84 kilohertz, respectively, and said center frequencies are disclosed in exemplary correspondence with some of the six frequency bands of the aforesaid ten to ninety kilohertz frequency spectrum.

At this time it should perhaps be stated that all of the devices and elements depicted in FIGS. 1 and 4 are conventional and available commercially per se; therefore, it is their unique interconnections and interactions that effect the new combination of elements constituting this invention and cause the new and/or improved results to be produced thereby.

Perhaps it should also be stated at this time that although the preferred embodiment of the invention specifically disclosed herewith involves marine vehicles, torpedoes, and underwater decays, and thus the system of FIG. 1 is disclosed as being of the sonar type pertinent to aqueous and subaqueous environments, it should be understood that it may be designed to operate in any suitable environment, if so desired. Hence, for instance, it may be designed to function under water, in the atmosphere, or in space to protect submarine, air, or space vehicles from attacking guided missiles or the like. So doing, of course, would merely involve the making of the proper design choices for any given environment, and would be well within the purview of one skilled in the art having the benefit of the teachings presented herewith. Accordingly, the discussion of the operation of the invention should not be considered as being limited solely to marine-type surface maneuvers or operations.

Furthermore, the signal generator of FIG. 1, itself, has numerous other applications that should now be readily apparent to the artisan; so the following discussion of the operation of the invention should, likewise, not be considered as being limited specifically thereto.

MODE OF OPERATION

The operation of the invention will now be discussed briefly in conjunction with all of the figures of the drawing.

Referring first to FIG. 4, there is shown a typical tactical maneuver that may include the subject invention to an advantage. For instance, there is shown a friendly marine vehicle, such as a ship 31, being attacked by an enemy homing torpedo 32 while it is traveling along an intended course in water 33. But to counter such torpedo attack, a mobile decoy 34 incorporating the subject invention is deployed, and while it is being propelled in some preprogramed direction, it broadcasts acoustical signals throughout water 33 and thereby attracts or decays torpedo 32 away from its originally intended target, viz., ship 31. Such decoy operation, of course, is effected because acoustical signals 35 have such waveform characteristics as will cause them to actuate the torpedo's homing system and do so in a manner that will cause them to be more intense or otherwise override those signals emanating from the actual target—in this case, ship 31.

The system of FIG. 1 produces the aforesaid torpedo attracting signals because it is mounted or housed within mobile decoy vehicle 34. In order to provide proper timing to the control inputs of staircase generators 12 and 13 and gates 14 and 15, so as to correlate the voltage step advancements of the former with the opening and closing of the latter, astable multi-vibrator 11 is set to free-run at a frequency that is twice the frequency of the step advancements. Hence, multivibrator 11 produces a control signal at the output thereof that has a "square" waveform similar to that shown in FIG. 2(A). Then, when this control signal is simultaneously applied to the control inputs of staircase generator 12 and gate 14, the leading edge of each cycle thereof is used to advance the voltage steps of staircase generator 12 at the same time that gate 14 is opened, thereby allowing a step voltage signal to pass therethrough. But when the following edge of each cycle thereof occurs, gate 14 is closed, thereby allowing the output voltage thereof to drop to zero.

As a general rule, staircase generator 12 should be designed to produce ten spaced voltage steps between some predetermined minimum voltage that is greater than zero and advance to some predetermined maximum voltage (say, for example, between 2.5 and 5.0 volts) with half volt steps therebetween. However, in general, as a result of the aforementioned operational procedure, the output signal from gate 14 has waveform characteristics similar to those shown in FIG. 2(B), regardless of the design voltages used.

Because it is necessary to the proper functioning of the invention for the operation of staircase generator 13 and gate 15 to alternate in time with respect to the similar operation of the aforesaid staircase generator 12 and gate 14, the trailing edge of each cycle of the signal of FIG. 2(A) is used to advance staircase generator 13 and open gate 15, while the leading edge thereof is used to timely effect closure of gate 15, and, of course, generator 13 and gate 15 are, thus, designed to do so. As a result, when a trailing edge of the control signal of FIG. 2(A) occurs, staircase generator 13 is advanced one voltage step and gate 15 is opened; and when a leading edge thereof occurs, gate 15 is closed, thereby producing a signal at the output of gate 15 that has the timing and waveform characteristics similar to those shown in FIG. 2(C).

Again, as a general rule, staircase generator 13 should be designed to produce ten spaced voltage steps and advance from some predetermined minimum voltage to some predetermined maximum voltage, with the minimum and maximum thereof different and preferably less than the minimum and maximum voltages of the aforesaid staircase generator 12 (say, for example, between 0.0 and 2.5 volts) with half volt steps therebetween.

As the maximum voltage of each staircase generator is reached, it constitutes a trigger signal that is equal to or greater than the preset voltage required to trigger the Schmitt and, hence, such maximum voltage outputs of staircase generators 12 and 13 trigger Schmitt triggers 16 and 17, respectively. Schmitt triggers 16 and 17, in turn, supply reset signals to the reset inputs of staircase generators 12 and 13, thereby causing them to be respectively reset to their minimum voltages—as exemplarily indicated by the return dashed lines in the waveforms of FIGS. 2(B) and (C)—to start the step sequence all over again.

Summing amplifier 18 adds the signals represented by the A waveforms of FIGS. 2(B) and (C) to produce a signal at the output thereof that has a waveform similar to that illustrated in FIG. 2(D). As may readily be seen therefrom, the tops of consecutive cycles increase in voltage in accordance with those of FIG. 2(B), and the bottoms of consecutive cycles increase in voltages in accordance with those of FIG. 2(C); therefore, as a result of properly setting the reset voltage of each staircase generator, a stairstep signal is produced that effectively acquires the characteristics of the programmed interlacing of the output signals from gates 14 and 15, and it is this interlaced stairstep signal that is used to actuate voltage controlled oscillators 20 to 25 to, in turn, effect the production of the aforesaid ten discrete frequency signals within the six separate bands making up the entire frequency spectrum.

The outputs of voltage controlled oscillators 20 through 25 are processed through summing power amplifier 26, so that they will acquire the useful level necessary to properly energize electroacoustical transducer 27. Of course, when so energized, transducer 27 broadcasts acoustical signals 35 which are, in fact, radiated at the frequencies depicted in the aforementioned FIG. 3 and cover the entire frequency band in which enemy homing torpedoes can effectively operate. The torpedo passbands hypothetically represented by those in FIG. 5 are typical homing system passbands and could be centered at any frequency within the limits of coverage of the voltage controlled oscillators chosen.

It, of course, would be obvious to the artisan to design the staircase generators and voltage controlled oscillators in such manner as to cause the disclosed unique combination thereof to produce any desired frequencies within any number of frequency bands within any width of frequency spectrum. It would, likewise, be obvious to select the type of transmitting transducer that would function properly to produce and broadcast whatever type of energy would be appropriate for attracting the vehicle intended to be decayed within any predetermined environmental medium. Hence, the subject invention ostensively has practically unlimited applications as a weapon countermeasure or other decaying device. In addition, it appears that the unique signal generator per se has copious applications, too.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:,

1. A signal generator, comprising in combination:

means, having a control input, a reset input, and an output, for generating a first increasing staircase voltage signal that advances by predetermined incremental voltage steps between first predetermined minimum and maximum voltages in response to a control signal timely supplied to the control input thereof;

means, having a data signal input, a control input, and an output, with the data signal input thereof connected to the output of said first increasing staircase voltage signal generating means, for timely gating the predetermined incremental voltage steps of the first increasing staircase voltage signal generated thereby in response to the aforesaid control signal being supplied to the control input thereof;

means connected between the output and the reset input of said first increasing staircase voltage signal generating means for the resetting thereof to said first minimum voltage whenever the first increasing staircase voltage signal generated thereby is advanced to said first maximum voltage;

means, having a control input, a reset input, and an output, for generating a second increasing staircase voltage signal that advances by predetermined incremental steps between second predetermined minimum and maximum voltages in response to the aforesaid control signal being timely supplied to the control input thereof;

means, having a data signal input, a control input, and an output, with the data signal input thereof connected to the output of said second increasing staircase voltage signal generating means, for timely gating the predetermined incremental voltage steps of the second increasing staircase voltage signal generated thereby in response to the aforesaid control signal being supplied to the control input thereof;

means connected between the output and the reset input of said second increasing staircase voltage signal generating means for the resetting thereof to said second minimum voltage whenever the second increasing staircase voltage signal generated thereby is advanced to said second maximum voltage;

means connected to the respective control inputs of said first and second increasing staircase voltage signals generating means and said gating means for simultaneously supplying said control signal thereto; and means connected to the outputs of said first and second increasing stairstep voltage signal gating means for adding the first and second increasing stairstep voltage signals gated thereby.

2. The device of claim 1 wherein said signal generator is a homing torpedo decoy signal generator.

3. The device of claim 1 wherein said signal generator is a homing missile decoy signal generator.

4. The device of claim I wherein said means, having a control input, a reset input, and an output, for generating a first increasing staircase voltage signal that advances by predetermined incremental voltage steps between first predetermined minimum and maximum voltages in response to a control signal timely supplied to the control input thereof comprises a staircase generator.

5. The device of claim 1 wherein said means, having a data signal input, a control input, and an output, with the data signal input thereof connected to the output of said first increasing staircase voltage signal generating means, for timely gating the predetermined incremental voltage steps of the first increasing staircase voltage signal generated thereby in response to the aforesaid control signal being supplied to the control input thereof comprises a control gate.

6. The device of claim 1 wherein said means connected between the output and the reset input of said first increasing staircase voltage signal generating means for the resetting thereof to said first minimum voltage whenever the first increasing staircase voltage signal generated thereby is advanced to said first maximum voltage comprises a Schmitt trigger.

7. The device of claim 1 wherein said means, having a control input, a reset input, and an output, for generating a second increasing staircase voltage signal that advances by predetermined incremental steps between second predetermined minimum and maximum voltages in response to the aforesaid control signal being timely supplied to the control input thereof comprises a staircase generator.

8. The device of claim 1 wherein said means, having a data signal input, a control input, and an output, with the data signal input thereof connected to the output of said second increasing staircase voltage signal generating means, for timely gating the predetermined incremental voltage steps of the second increasing staircase voltage signal generated thereby in response to the aforesaid control signal being supplied to the control input thereof comprises a control gate.

9. The device of claim 1 wherein said means connected between the output and the reset input of said second increasing staircase voltage signal generating means for the resetting thereof to said second minimum voltage whenever the second increasing staircase voltage signal generated thereby is advanced to said second maximum voltage comprises a Schmitt trigger.

10. The device of claim 1 wherein said means connected to the respective control inputs of said first and second increasing staircase voltage signals generating means and said gating means for simultaneously supplying said control signal thereto comprises an astable multivibrator.

11. The device of claim 1 wherein said means connected to the respective control inputs of said first and second increasing staircase voltage signals generating means and said gating means for simultaneously supplying said control signal thereto comprises a free-running multivibrator having a frequency that is twice that of the frequency of the incremental voltage step advances of the aforesaid first and second increasing staircase voltage signals generating means.

12. The device of claim 1 wherein said means connected to the outputs of said first and second increasing stairstep voltage signal gating means for adding the first and second increasing stairstep voltage signals gated thereby comprises a summing amplifier.

13. The invention of claim 1 further characterized by a plurality of voltage controlled oscillators having consecutively increasing frequency ranges, each of which has a center frequency spaced from that of the others and a frequency range that does not overlap those of the others, connected to the output of said first and second increasing stairstep voltage signal adding means.

14. The invention according to claim 1 further characterized by:

a plurality of voltage controlled oscillators having consecutively increasing frequency ranges, each of which has a center frequency spaced from that of the others and a frequency range that does not overlap those of the others, connected to the output of said first and second increasing stairstep voltage signal adding means; and a summing power amplifier connected to the outputs of said plurality of voltage controlled oscillators.

15. The invention according to claim 1 further characterized by:

a plurality of voltage controlled oscillators having consecutively increasing frequency ranges, each of which has a center frequency spaced from that of the others and a frequency range that does not overlap those of the others, connected to the output of said first and second increasing stairstep voltage signal adding means;

a summing power amplifier connected to the outputs of said plurality of voltage controlled oscillators; and a transmitting transducer connected to the output of said summing power amplifier.

16. The invention of claim 15 further characterized by a mobile decoy vehicle housing said signal generator.

* * * * *